US007080883B1

(12) United States Patent
Custer

(10) Patent No.: US 7,080,883 B1
(45) Date of Patent: Jul. 25, 2006

(54) CHAIR COVER

(76) Inventor: Deborah A. Custer, 6590 Weathersfield, Canton, MI (US) 48187

( * ) Notice: Subject to any disclaimer, the term of this patent is extended or adjusted under 35 U.S.C. 154(b) by 0 days.

(21) Appl. No.: 11/045,553

(22) Filed: Jan. 31, 2005

(51) Int. Cl.
*A47C 31/00* (2006.01)

(52) U.S. Cl. ..... 297/229; 297/228.1; 297/225

(58) Field of Classification Search ..... 297/228.1, 297/229, 225, 219.1
See application file for complete search history.

(56) References Cited

U.S. PATENT DOCUMENTS

| | | | | |
|---|---|---|---|---|
| 2,129,225 | A | 9/1938 | Mednick | |
| 3,858,256 | A | 1/1975 | Beer | |
| 6,079,778 | A * | 6/2000 | Lindberg | 297/229 |
| 6,634,709 | B1 * | 10/2003 | Hetherington | 297/229 |
| 2005/0173953 | A1 * | 8/2005 | Riley | 297/228.1 X |

* cited by examiner

*Primary Examiner*—Anthony D. Barfield
(74) *Attorney, Agent, or Firm*—Charles W. Chandler

(57) ABSTRACT

A chair cover removably mounted on a chair. The cover has a pair of overlapping skirts between the chair's front legs, forming a vertical slit permitting a chair occupant to place his foot between the skirts and beneath the chair seat.

4 Claims, 1 Drawing Sheet

CHAIR COVER

BACKGROUND AND SUMMARY OF THE INVENTION

The invention relates to a chair cover. In particular, the invention relates to a chair cover that includes a pair of front overlapping skirts providing a vertical slit permitting the user to place his feet beneath the chair, and a cinching strap for further securing the chair cover to the chair.

It is often desirable to cover chairs, especially temporary use chairs, as the chairs often do not have a pleasing appearance, may have become stained with prior use, or to prevent staining. Although many styles of chair covers exist, these are difficult to use by a seated individual because the cover extends to the ground blocking a seated user from placing his feet beneath the chair.

Further, adjusting a chair cover is typically done to improve the fit of the cover to the chair. This adjustability is typically accomplished by two flaps at the rear of the chair that are drawn together and secured, as in U.S. Pat. Nos. 2,129,225 and 3,858,256. This type of adjustment has an elongated line, at the back of the chair, that is not pleasing in appearance once secured together, either by tying strings together, buttons or long pieces of hook and loop material.

Therefore, it is desirable to have a chair cover having a front panel or skirt that allows a user to place his feet inside the cover and beneath the chair seat, as well as, a strap that easily adjusts the chair cover to the specific chair being used.

A chair cover is disclosed for improving the aesthetics of a chair, and includes left and right panels that overlap between the front chair legs. The panels permit the user to place his feet between the front legs.

Still further objects and advantages of the invention will become readily apparent to those skilled in the art to which the invention pertains upon reference to the following detailed description:

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
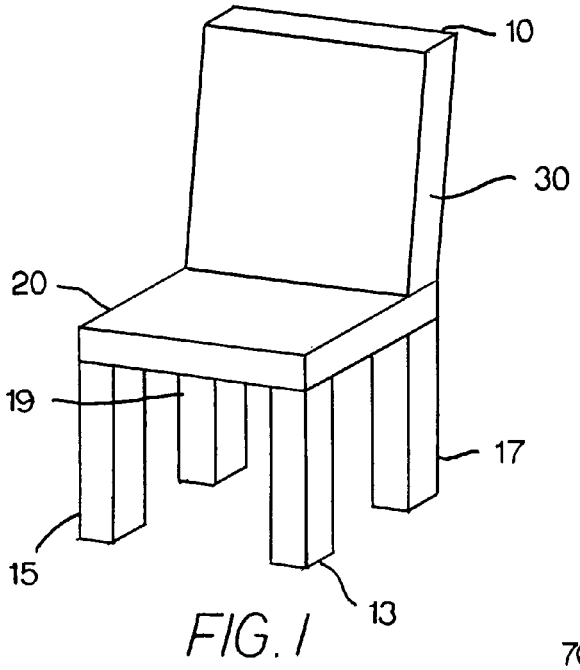
FIG. 1 is an isometric front view of a chair.

FIG. 1 shows a typical four-legged chair 10. Chair 10 has a forward leg 13, a forward leg 15, a rearward leg 17, and a rearward leg 19. The lower end of each leg is suited for supporting the chair on a surface, usually the ground or flooring. The upper ends of the legs are attached to the four corners of a square seat 20.

Figure 2:
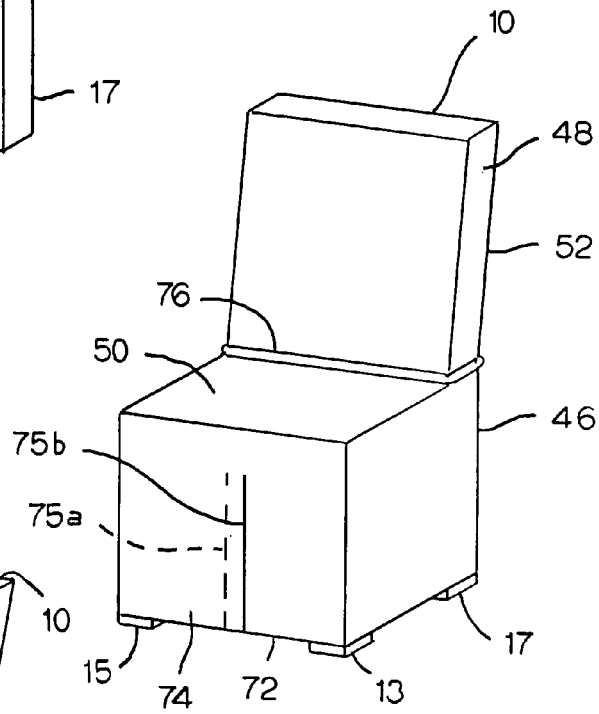
FIG. 2 is an isometric, partially cut-away, front view of a chair with a preferred cover mounted on the chair.

Referring to FIG. 2, chair 10 is shown with a cover 46. Cover 46 comprises a back 48 and a seat 50. Back 48 includes a sleeve 52 for receiving back 30. The cover extends to the lower ends of the four legs.

The front of cover seat 50 includes a left skirt 72 and a right skirt 74. The left and right skirts extend from the chair seat to the lower ends of the front legs. The inner vertical edges 75*a* and 75*b* of skirts 72 and 74 overlap about six inches adjacent the center of the two front legs to form a slit allowing a user to pass a foot between the overlapping skirts to a location beneath the seat. The cover could have more than one such slit.

Figure 3:
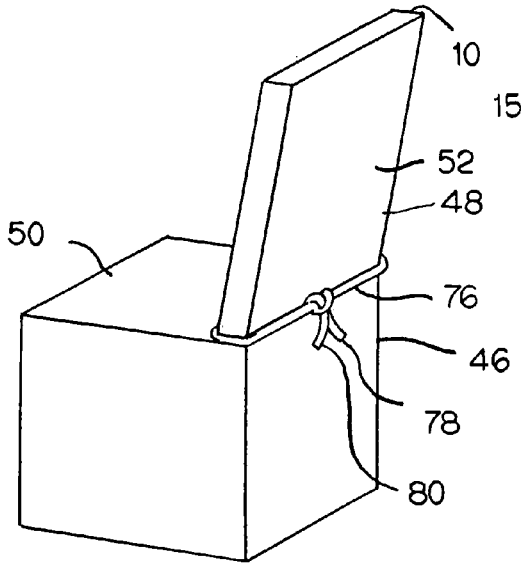
FIG. 3 is a view of the chair and cover of FIG. 2.

A flexible strap 76 secures chair cover 46 to chair 10. Strap 76 is made from an elastic material that stretches to secure cover 46 to multiple styles of chairs. Referring to FIG. 3, strap 76 has a pair of ends 78 and 80. The two strap ends are tied together to create a loop for securing cover 46 to chair 10. Strap 76 can be of any color or thickness so that it either blends in with cover 46 or provides an accent color that corresponds with the colors of the event.

In use, chair cover 46 is positioned such that sleeve 52 aligns with chair back 30, and seat cover 50 rests on seat 20. The remainder of the cover is then placed over the seat and legs of the chair as shown in FIG. 3. Strap 76 is then stretched over back 30, adjacent the chair seat. Strap 76 cinches cover 46 to chair 10 such that any extra material is taken up to provide a form-fitted appearance.

When the covered chair is occupied, the user can insert a foot and leg between the overlapping skirts either for comfort, or to rise from the chair.

The invention has been described in an illustrative manner, and it is to be understood that the terminology, which has been used, is intended to be in the nature of words of description rather than of limitation.

Many modification and variations of the present invention are possible in light of the above teachings. It is, therefore, to be understood that within the scope of the appended claims, the invention may be practiced other than as specifically described.

I claim:

1. A one-piece seat cover, comprising:

a back portion suited for mounting on a chair back;

a seat portion attached to the back portion, the seat portion having an integral depending first skirt and an integral depending second skirt that drape down between the front legs of a four-legged chair when the seat portion is removably disposed on the seat of a four-legged chair;

an inner vertical edge of one of the skirts overlapping an inner vertical edge of the other of the skirts to form at least one slit extending from the chair seat to the lower ends of the front chair legs; and whereby a user can place a foot and lower leg in the slit and between the skirts to a position beneath the seat of the four-legged chair.

2. A cover, as set forth in claim 1, including a strap for securing the cover to the chair.

3. A cover, as set forth in claim 1, wherein said strap is produced with an elastic material for quickly adapting said cover to said chair.

4. A cover, as set forth in claim 1, wherein said strap is produced of a similar color to that of said cover for blending into said cover.

* * * * *